US011434838B2

(12) United States Patent
Van Keulen

(10) Patent No.: US 11,434,838 B2
(45) Date of Patent: Sep. 6, 2022

(54) ADAPTIVE ENGINE CONTROL

(71) Applicant: DAF Trucks N.V., Eindhoven (NL)

(72) Inventor: Thijs Adriaan Cornelis Van Keulen, Eindhoven (NL)

(73) Assignee: DAF Trucks N.V., Eindhoven (NL)

( * ) Notice: Subject to any disclaimer, the term of this patent is extended or adjusted under 35 U.S.C. 154(b) by 0 days.

(21) Appl. No.: 16/973,654

(22) PCT Filed: Jun. 12, 2019

(86) PCT No.: PCT/NL2019/050353
§ 371 (c)(1),
(2) Date: Dec. 9, 2020

(87) PCT Pub. No.: WO2019/240574
PCT Pub. Date: Dec. 19, 2019

(65) Prior Publication Data

US 2021/0246843 A1 Aug. 12, 2021

(30) Foreign Application Priority Data

Jun. 12, 2018 (NL) ..... 2021108

(51) Int. Cl.
*F02D 41/00* (2006.01)
*F02B 37/24* (2006.01)
(Continued)

(52) U.S. Cl.
CPC ..... *F02D 41/005* (2013.01); *F02B 37/24* (2013.01); *F02D 41/0007* (2013.01);
(Continued)

(58) Field of Classification Search
CPC ..... F02D 41/0007; F02D 41/0047; F02D 41/005; F02D 41/1406; F02D 41/1447;
(Continued)

(56) References Cited

U.S. PATENT DOCUMENTS

2007/0074512 A1* 4/2007 Evers ..... F02D 41/005 60/602
2016/0025020 A1 1/2016 Hodzen et al.
(Continued)

FOREIGN PATENT DOCUMENTS

DE 102009016509 A1 10/2010
GB 2520637 A 5/2015
WO 03016698 A1 2/2003

OTHER PUBLICATIONS

Robert Van Der Weijst et al., "A generalized framework for perturbation-based derivative estimation in multivariable axtremum-seeking", Frankfurt, Munchen, vol. 50, No. 1, pp. 3148-3153.
(Continued)

*Primary Examiner* — Audrey B. Walter
(74) *Attorney, Agent, or Firm* — Banner & Witcoff, Ltd.

(57) ABSTRACT

According to the invention, a method for air path control of a combustion engine is provided, comprising an EGR valve and a VGT turbine. The method comprises providing a cost function of a measured delta pressure between engine intake and exhaust manifold; determining a gradient of the cost function as a function of a delta pressure set point, determining a gradient of a constraint function for estimated NOx emission level, turbine rate; and oxygen level as a function of delta pressure; real time controlling the NOx emission level and delta pressure to respective desired NOx and delta pressure set points by adjusting the EGR valve and/or the VGT turbine, wherein the delta pressure set point is adjusted according to an integration of a selected gradient direction of the cost function selected from the determined one or more of the gradients, wherein the determined gradients are prioritized in the order of turbine rate, oxygen level and NOx emission level; and wherein NOx emission level and or a turbine rate and or oxygen levels are constrained; and wherein the adjusted delta pressure set point is perturbed in an extremum seeking operation on the cost function.

5 Claims, 5 Drawing Sheets

(51) Int. Cl.
*F02D 41/14* (2006.01)
*F02D 41/40* (2006.01)

(52) U.S. Cl.
CPC ..... *F02D 41/0047* (2013.01); *F02D 41/1447* (2013.01); *F02D 41/1458* (2013.01); *F02D 41/1462* (2013.01); *F02D 41/401* (2013.01); *F02D 41/1406* (2013.01); *F02D 2200/024* (2013.01)

(58) Field of Classification Search
CPC ..... F02D 41/1458; F02D 41/1462; F02D 41/401; F02D 2200/024; F02B 37/24
See application file for complete search history.

(56) References Cited

U.S. PATENT DOCUMENTS

2018/0058391 A1* 3/2018 Gibson ..... F02D 41/0002
2019/0218981 A1* 7/2019 Styles ..... F02D 41/0065

OTHER PUBLICATIONS

Chris H A Criens et al., "Disturbance Rejection in Diesel Engines for Low Emissions and High Fuel Efficiency", IEEE Transactions on Control Systems Technology, New York, NY, vol. 23, No. 2, pp. 662-669.
Nov. 9, 2019, International Search Report and Written Opinion, PCT/NL2019/050353.

* cited by examiner

ADAPTIVE ENGINE CONTROL

CROSS-REFERENCE TO RELATED APPLICATIONS

This application is a U.S. National Stage application under 35 U.S.C. § 371 of International Application PCT/NL2019/050353 (published as WO 2019/240574 A1), filed Jun. 12, 2019, which claims the benefit of priority to Application NL 2021108, filed Jun. 12, 2018. Benefit of the filing date of these prior applications is hereby claimed. Each of these prior applications is hereby incorporated by reference in its entirety.

The invention relates to a control method of air and/or fuel path control for a combustion engine, comprising exhaust gas recirculation (EGR) and electronically controlled diesel injection equipment. Examples of control inputs are an EGR valve a variable turbine geometry (VGT), timing and quantity of the diesel injection.

Turbocharged diesel engines with high pressure exhaust gas recirculation are known to have a trade-off between fuel economy and NOx emissions. Naturally, the engine is equipped with an after treatment system that strictly limits the engine-out NOx emissions such that the tailpipe emissions comply with legislation. The NOx conversion capabilities of the after treatment typically depend on the temperature of the after treatment system.

For optimization of fuel economy, i.e. the delivered amount of energy at the crank shaft resulting from the consumption of a given amount of fuel, typically no direct measurement parameters are available to quantify the fuel economy in the hardware setup of a diesel engine. So actual fuel economy is typically not known and hence direct optimization of this parameter is not possible. One factor of influence is the pressure difference between the intake and exhaust manifold, which is known to influence the fuel economy vs NOx trade-off: a high pressure difference leads to increased EGR mass flow which reduces the formation of NOx during the combustion. A high pressure difference however also increases the scavenging losses and hence the fuel economy. Another factor of influence is the timing of the fuel injection. A fast combustion around Top Dead Centre (TDC) leads typically to high fuel economy. However, also leads to high combustion temperatures and therefore to enhanced formation of NOx. So, best fuel economy is obtained with high engine out NOx emissions, which is constrained by the tailpipe legal limits and after treatment conversion capabilities.

In addition, the engine operation is subject to hardware limitations such as maximum turbine speed, maximum exhaust manifold temperature, minimum exhaust gas temperature for after treatment conversion efficiency, and limitations on the combustion process such as the peak fire pressure. Hence, a constrained optimal control problem is obtained where the objective is to find the maximum fuel economy for which the engine out NOx target is met and also remains within the limitations set by the engine hardware and operation.

Control of engine-out emissions is previously suggested, for example in Criens, C. H. A. (2014). Air-path control of clean diesel engines: for disturbance rejection on NOx, PM and fuel efficiency Eindhoven: Technische Universiteit Eindhoven DOI: 10.6100/IRA769972. The air path control problem is a multivariable control problem meaning that both air path actuators, EGR valve and VGT, influence NOx emissions and fuel economy. In Criens, it is demonstrated that static decoupling is successful in enabling decentralized control of NOx emissions and robustness to variations in fuel economy. An air path control strategy is suggested that uses static decoupling in combination with decentralized proportional integral control to control the engine-out NOx mass flow and the pressure difference between the intake and exhaust manifold (directly related the scavenging losses) to a desired set point by utilizing the EGR valve and VGT setting. This low level control setting is deemed known to the skilled person and is part of the back ground knowledge of this application.

In cylinder pressure sensors can provide information regarding the combustion phasing and the indicated mean effective pressure (IMEP). It is possible to expand the control approach of Criens to the fuel injection settings. Using in cylinder pressure sensors, functional control over combustion phasing and IMEP, besides NOx emissions and scavenging losses, can be achieved.

However, due to production tolerances, changing environmental conditions, wear and fouling, optimal actuator settings and optimal setpoints for the pressure difference between the intake and exhaust manifold and combustion phasing can vary in time and from engine to engine. Therefore, offline calibration results in suboptimal engine operation under real-life conditions and to meet hardware limitations under all conditions the nominal calibration might be conservative.

Accordingly, it is an objective of the invention to provide an adaptive control system that a) can optimize fuel economy online without a direct measurement of fuel mass flow or engine output power, b) for limited engine out NOx mass flow, c) while accounting for hardware and operational limitations such as turbine speed and peak fire pressure.

To maximize the fuel economy of diesel engines and to comply with emission legislation advanced control concepts are required. The aim of this application is to develop a controller that fully exploits the fuel-path and air-path hardware, and is adaptive for real-world disturbances, and meets the operational limits of the engine.

In a more general sense it is thus an object of the invention to overcome or reduce at least one of the disadvantages of the prior art. It is also an object of the present invention to provide alternative solutions which are less cumbersome in assembly and operation and which moreover can be made relatively inexpensively. Alternatively it is an object of the invention to at least provide a useful alternative.

Next, two possible embodiments are further detailed. The first considering air path actuators. The second using in addition in cylinder pressure sensor(s) and fuel injection settings.

According to the invention, a method for air path control of a combustion engine is provided, comprising an EGR valve and a VGT turbine, the method comprising:

providing a cost function of a measured delta pressure between engine intake and exhaust manifold and constraint functions of a distance between an actual value to a limit value of a turbine rate, a NOx emission level, and a oxygen level;

estimating a NOx emission level in the outlet;

estimating an oxygen level in the engine outlet;

determining a gradient of the cost function as a function of the setpoint for delta pressure between engine intake and exhaust manifold; and as a function of estimated NOx emission level, turbine rate; and oxygen level;

real time controlling the NOx emission level and delta pressure to respective desired NOx and delta pressure set points by adjusting the EGR valve and/or VGT position using static decoupling, wherein the delta pressure set point is adjusted according to an integration of a selected gradient direction of the cost function selected from the determined one or more of the gradients as being most sensitive to pertubation, wherein the determined gradients are prioritized in the order of turbine rate, oxygen level and NOx emission level;

wherein NOx emission level and or a turbine rate and oxygen level are constrained;

wherein the adjusted delta pressure set point is perturbed in an extremum seeking operation on the cost function, e.g. using a sinusoidal signal.

According to another aspect of the invention, a method for air and fuel path control of a combustion engine, comprising an EGR valve, a VGT turbine, and electronically controlled fuel injection settings, the method comprising:

providing a cost function of a fuel economy parameter derived from injector opening time;

estimating a NOx emission level in the outlet;

estimating the delta pressure between the intake and exhaust manifold;

estimating a combustion phasing parameter (e.g. CA50, the crank angle where 50% of the heat is released) and IMEP from in cylinder pressure and encoder measurements;

estimating an oxygen level in the engine outlet;

determining a maximum turbine rate and a maximum NOx emission level and a minimum or maximum exhaust gas temperature;

determining constraint functions providing the distance of the actual value to the limit value determining a gradient of the cost function as a function of the setpoint for delta pressure between engine intake and exhaust manifold; and the setpoint for combustion phasing;

determining a gradient of the constraint functions as a function of the setpoint for delta pressure between engine intake and exhaust manifold; and the setpoint for combustion phasing;

real time adjusting the EGR valve and/or VGT position, injection timing and quantity by static decoupling and controlling the NOx emission level and delta pressure, combustion phasing and IMEP to respective desired set NOx, delta pressure, combustion phasing and IMEP set points, wherein the delta pressure and combustion phasing set point are adjusted according to a selected gradient direction of the cost function selected from the determined one or more of the gradients, wherein a selected one gradient is prioritized in the order of turbine rate, oxygen level and NOx emission level; and exhaust gas temperature wherein NOx emission level and or a turbine rate are constrained to a set variables of a maximum NOx level; a maximum turbine rate; and a minimum oxygen level and a minimum or maximum exhaust gas temperature wherein the adjusted delta pressure and combustion phasing setpoint is perturbed in an extremum seeking operation on the cost function, e.g. using two independent sinusoidal signals for delta pressure and combustion phasing.

The control design comprises a feedback control system, which uses air-path actuators and/or fuel injection settings to robustly track engine-out NOx emission and IMEP demands, as well as parameters that are known to influence the NOx emission versus fuel economy trade-off; combustion phasing and pumping losses.

The invention has as an advantage, that by this method, an on-line implementable convex cost criterion can be proposed that evaluates the injector opening time or an estimate of the fuel mass flow to obtain a cost output which is equivalent to fuel economy. Note that the absolute estimate of fuel economy is not important, only the location of the optimum as a function of delta pressure and combustion phasing. A multivariable constrained extremum-seeking method can be applied to optimize the cost output, as a function of combustion phasing and pumping losses, subject to constraints on the tracking performance of the low-level control system. The control design may be implemented on a Euro-VI Diesel engine equipped with exhaust gas recirculation and a variable geometry turbine. Pressure sensors may be applied within the cylinders of the combustion engine. The applied extremum-seeking approach can be effective in finding the (constrained) optimum, for a constant engine speed and torque.

The invention will further be elucidated by description of some specific embodiments thereof, making reference to the attached drawings. The detailed description provides examples of possible implementations of the invention, but is not to be regarded as describing the only embodiments falling under the scope. The scope of the invention is defined in the claims, and the description is to be regarded as illustrative without being restrictive on the invention. In the drawings:

FIG. 1 schematically shows a schematic setup of an exemplary system comprising a turbocharged engine including an air path controller;

Figure 1:
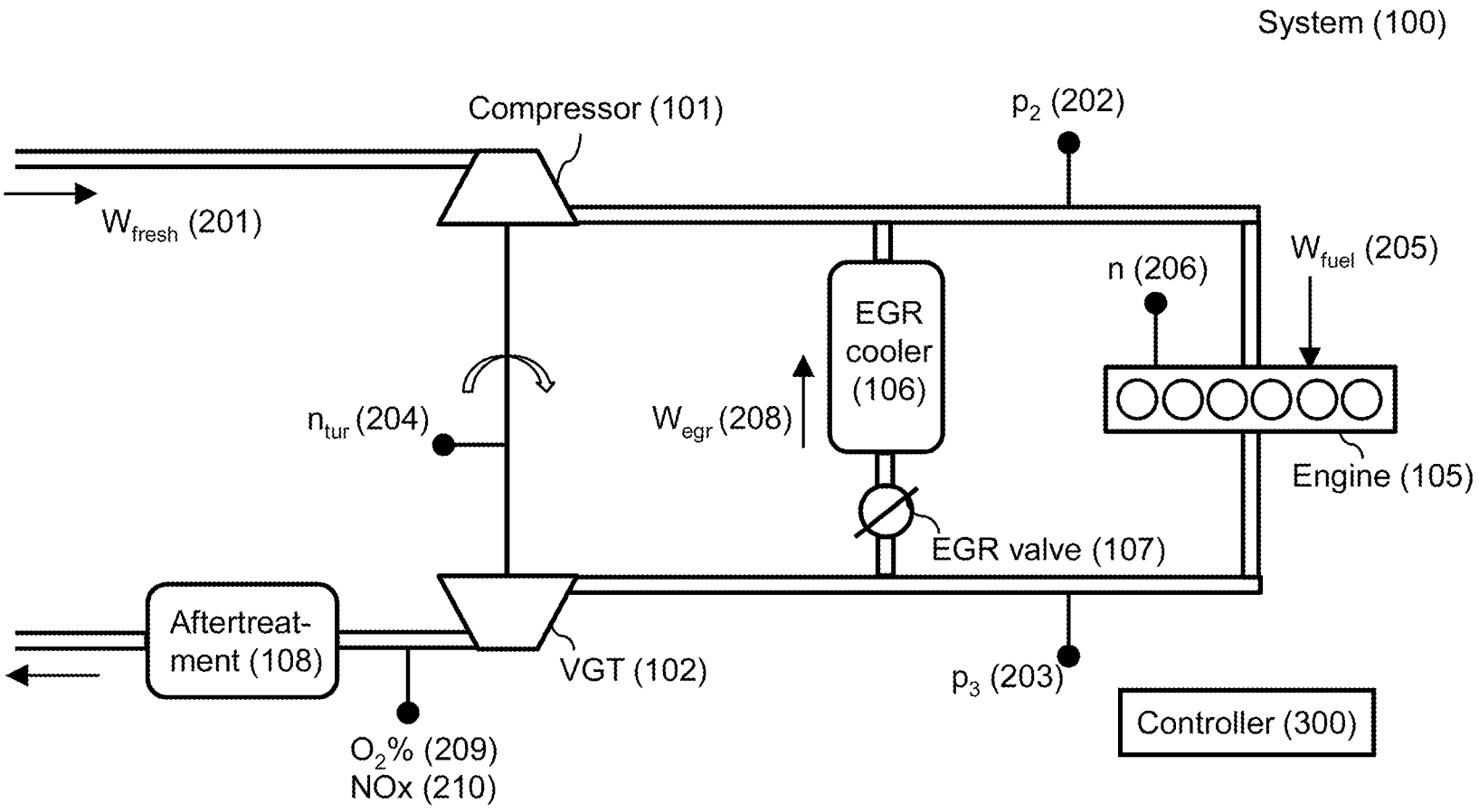

In FIG. 1 a schematic overview of the system 100 layout is depicted. An air path is disclosed of air circulating and flowing in the engine system 100. In the air path an amount of fresh air $W_{fresh}$ 201 is introduced, i.e. the mass flow of fresh air into the engine system 100, and mixed with EGR mass flow $W_{egr}$ 208 of an EGR cooler 106.

In the system layout, a compressor 101 is located in an inlet flow path of the engine. The compressor 101 may be propelled by a turbine 102, that may be mechanically coupled. In another form, multistage turbochargers are envisioned. A compressor rotational speed sensor $n_{tur}$ 204 may be provided. In the exemplary embodiment, the turbine includes an actuator which can be used to optimize the turbocharger performance at different operating conditions, e.g., a Variable Geometry Turbine VGT or a Variable Nozzle Turbine VNT. In yet another form, compressor and turbine assemblies which are not only mechanically coupled are envisioned, for example an electric assisted turbocharger also known as e-turbo. Further, a pressure sensor 202 is provided able to measure a pressure (pin) in the intake manifold of the engine. Similarly pressure 203 may be provided to measure a pressure (pex) in the exhaust manifold. Pressure sensors may be present to obtain pin and pex in [kPa] and dp defined by pex pin as scavenging losses.

Additionally the engine may be equipped with in-cylinder pressure sensors (in one cylinder, or one in each cylinder) and a high resolution (0.1 degree crank angle) crank angle encoder. Using the in-cylinder pressure and the crank angle, for each of the six cylinders, the following parameters can be obtained: 1) the net IMEP, IMEPn in [bar], is equal to the indicated work of one complete (four-stroke) cycle and thus relates to engine power, and 2) combustion phasing parameter CA50 in [°CA], which is the crank angle (CA) relative to top dead centre (TDC), at which half of the total heat is released.

In one form, the engine 105 is a six cylinder four-stroke internal combustion engine. Estimation of the injected fuel mass flow $W_{fuel}$ 205 may be available. In another form, the engine has a different number of cylinders or a different number of operating cycles. Furthermore, to reduce the engine out NOx mass flow to legal limits, the engine system could be equipped with an after-treatment system 108 which could include a particle filter and a catalyst.

The recirculated exhaust gas may be cooled in EGR cooler 106 and an EGR valve 107 might be employed to regulate the recirculated mass flow $W_{egr}$ 208. In the system 100 a controller 300 is arranged to control the air path of the diesel engine, in particular, by control of the EGR valve 107 and the VGT setting of the turbine further specified in subsequent figures. The controller may be arranged in hardware, software or combinations and may be a single processor or comprise a distributed computing system. Typically, a controller operates in time units such as (numbers of) clock cycles that define a smallest time frame wherein data can be combined by logical operations.

Measurement of the oxygen concentration of the exhaust gas 02% 209 can be performed by various methods. E.g with a direct measurement or with knowledge of the fresh air mass flow $W_{fresh}$ 201 and fuel mass flow $W_{fuel}$ 205, the oxygen level can be estimated in exhaust gas mass flow. For example: The oxygen concentration in the exhaust can be computed by:

$$\hat{O}_{2\%exh} = O_{2\%air} - \frac{O_{2\%air} \cdot L_{stoich} \cdot W_{fuel}}{W_{fresh}}$$

In which $W_{fuel}$ (205) is the fuel mass flow, O2% air is the oxygen concentration of fresh air, and $L_{stoich}$ is the stoichiometric air-fuel ratio.

The air to fuel ratio is defined as:

$$\lambda = \frac{W_{fresh}}{L_{stoich} W_{feul}}$$

The reference NOx value 210 could be based on offline tuned look-up tables which are parameterized by engine speed (206) and fuel mass flow (205). Controlling the engine-out NOx emissions (and scavenging losses) to a desired set point does not ensure that the emissions are obtained with minimal fuel consumption. Moreover, under certain conditions (e.g. at low ambient pressure at high altitude) the turbine speed might become a limiting factor.

The industrial standard in Diesel engine control entails a look-up table based feedforward and feedback control based on various combinations of control variables. The availability of in-cylinder pressure sensors (which are not yet standard in trucks) increases the effectiveness of feedback control, as it enables a more direct measurement of the combustion behavior. To be precise, indicated mean effective pressure (IMEP) (related to power) and combustion phasing parameters such as CA50 can be measured that is linked to the fuel economy. Both air and fuel paths are known to influence the NOx/BSFC trade off. As such, adequate tuning of the reference signals rdp and rCA50 can be used to obtain an optimal fuel economy.

Although feedback control improves the robustness of the engine control system in terms of disturbance rejection, the high-level optimization problem of determining the related reference signals is typically addressed by off-line (manual) tuning in an engine test cell. As a result, the obtained performance, in terms of the engine-out NOx mass flow and fuel economy, remains sensitive to real-world disturbances such as production tolerances, fouling and aging.

Figure 2:
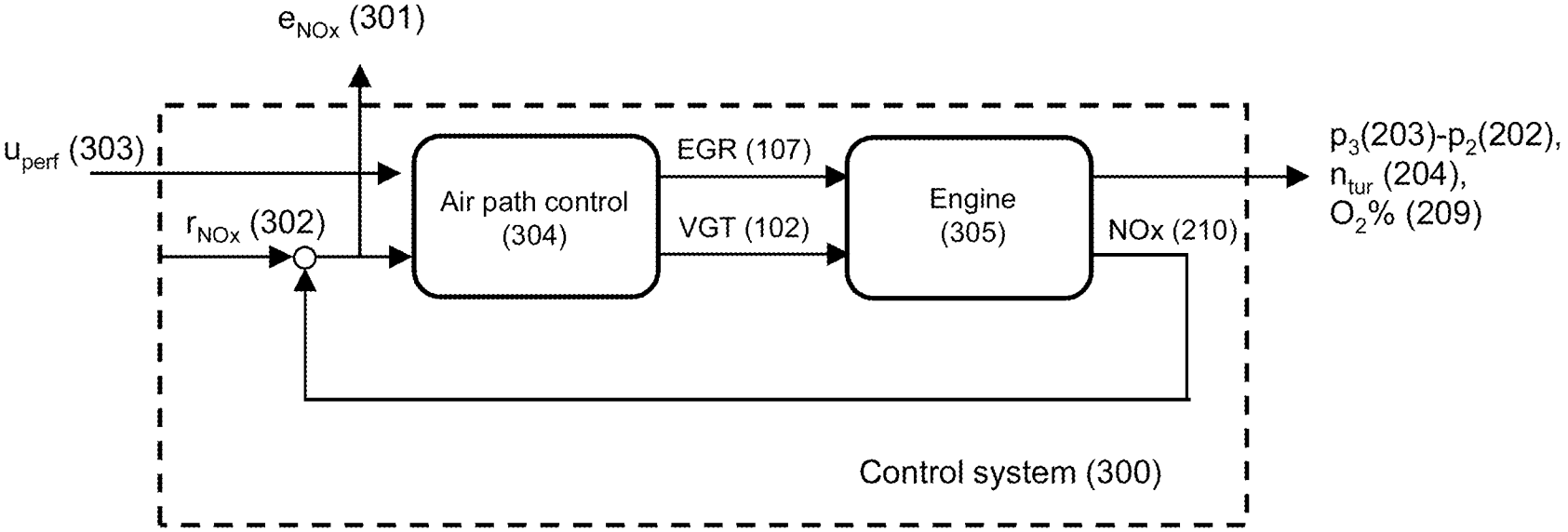
FIG. 2 shows a detail control scheme of the air path controller.

FIG. 2 in more detail illustrates an air path controller 300 that can adjust the air path and/or the fuel path of the system to particular operating conditions.

A high level control for engine 305 is based by adjusting the EGR valve 107 and VGT turbine setting 102 by an air path controller 304 on the basis of a performance variable that is determined in an initial value $u_{perf}$ 303 and a setpoint NOx value 'NOx 302, e.g., desired scavenging losses or exhaust manifold pressure 203 and perturb the value in subsequent time steps to constitute a variation. Subsequently the actual scavenging losses are obtained by measurement or estimation, e.g., using the intake manifold and exhaust manifold pressure 202 and 203. Also, the actual NOx control error is measured in 301, as well as hardware variables that are relevant for hardware and process limitations, e.g. by measuring the actual values relevant for hardware and process limitations, e.g., turbo speed 204 and/or oxygen concentration in the exhaust 209, see FIG. 1. Air path control can be implemented in several ways, e.g. as described in Criens cited earlier.

Figure 3:
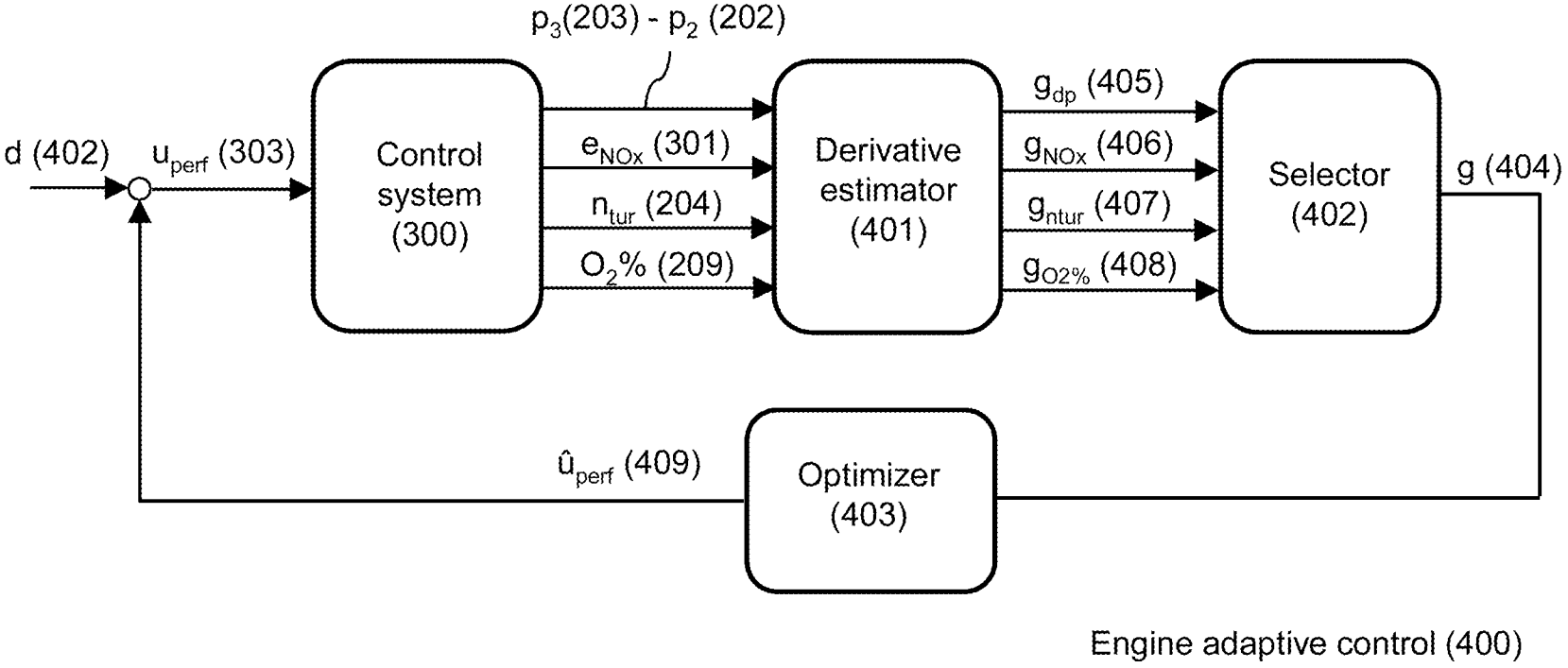
FIG. 3 shows a further control loop for real time adjusting the EGR valve and/or the VGT based on a selected gradient.

FIG. 3 in more detail illustrates an enhanced air path control 400, wherein real time adjusting the EGR valve and/or the turbine controller is based on a switched control variable having a determined gradient selected from the determined one or more of gradients of a cost function that is equivalent to fuel economy. One estimation of the cost function can be as follows. Minimizing the delta pressure between intake and exhaust manifold reduces the scavenging losses. Another estimation of the cost function could be: For a given rail pressure and power demand, i.e. rIMEPn and engine speed, a minimum injector opening time, results in the demanded net IMEP, corresponds with the minimum BSFC for that engine power. Hence, by evaluating a cost criteria based on the average injection duration over the six cylinders, fuel consumption optimization is possible without a direct measurement of fuel mass flow. To suppress operating point dependency (i.e. engine speed and load), the proposed cost function J, based on injection duration, may be normalized. The normalization is achieved by dividing the BSFC estimate by default look-up table based values, as a function of engine speed and rIMEP. As a result, J~1. A decrease in J corresponds to a decreasing BSFC.

To facilitate the estimation of the sensitivities (i.e. gradients) (405)-(409) the input initial value $u_{perf}$ can possibly be perturbed by a dither signal, e.g., $$d(t)=a\cos(\omega_d t)$$

where α is the dither amplitude and $\omega_d$ is the dither frequency. If the perturbation is slow compared to the system dynamics, then the sensitivities appear as a static input-output equilibrium map. In the enhanced controller 400, one or more variables are controlled by control system 300, e.g. a delta pressure between engine intake and engine outlet, i.e. scavenging losses or exhaust manifold pressure 203; a NOx emission level 301 in the outlet; turbo speed 204 and oxygen level 209. These set values are provided to derivative estimator 401 that determines a cost function gradient of one or more of pressure difference, estimated NOx emission level, turbine rate and oxygen level. For an adaptive on-line optimization technique little knowledge about the system is required. The only requirements are the system is stable and possesses a quasi-convex steady-state input output mapping.

By modulating the system response with the perturbation signal, we obtain an estimate of the local gradient of the input-output equilibrium map. For example, sensitivities (ie the gradient) of delta pressure, NOx, O2% and turbine speed constraint functions to the dither signal d(t), can be computed by application of a moving average filter:

$$DE := \begin{cases} \dot{x}_{dp}(t) = -\omega_{HP} x_{dp}(t) + \omega_{HP} h_{dp}(t) \\ y_{dp}(t) = -x_{dp}(t) + h_{dp}(t) \\ g_{dp}(t) - \frac{1}{T_{MA}} \int_{t-T_{MA}}^{t} \left[\frac{2}{a}\cos(\omega_d \tau) y_{dp}(\tau)\right] d\tau \end{cases}$$

$$DE := \begin{cases} \dot{x}_{NOx}(t) = -\omega_{HP} x_{NOx}(t) + \omega_{HP} h_{NOx}(t) \\ y_{NOx}(t) = -x_{NOx}(t) + h_{NOx}(t) \\ g_{NOx}(t) - \frac{1}{T_{MA}} \int_{t-T_{MA}}^{t} \left[\frac{2}{a}\cos(\omega_d \tau) y_{NOx}(\tau)\right] d\tau \end{cases}$$

$$DE := \begin{cases} \dot{x}_{O\,2\%}(t) = -\omega_{HP} x_{O\,2\%}(t) + \omega_{HP} h_{O\,2\%}(t) \\ y_{O\,2\%}(t) = -x_{O\,2\%}(t) + h_{O\,2\%}(t) \\ g_{O\,2\%}(t) - \frac{1}{T_{MA}} \int_{t-T_{MA}}^{t} \left[\frac{2}{a}\cos(\omega_d \tau) y_{O\,2\%}(\tau)\right] d\tau \end{cases}$$

$$DE := \begin{cases} \dot{x}_{n_{tur}}(t) = -\omega_{HP} x_{n_{tur}}(t) + \omega_{HP} h_{n_{tur}}(t) \\ y_{n_{tur}}(t) = -x_{n_{tur}}(t) + h_{n_{tur}}(t) \\ g_{n_{tur}}(t) - \frac{1}{T_{MA}} \int_{t-T_{MA}}^{t} \left[\frac{2}{a}\cos(\omega_d \tau) y_{n_{tur}}(\tau)\right] d\tau \end{cases}$$

Here, $T_{MA}=2\pi/\omega$ is the time window of the moving average filter which relates to the dither frequency, and a first order high pass filter is employed to remove the static component from the derivative estimate. In all cases the sensitivity is determined while NOx emission level and/or a turbine rate are constrained to set variables of a maximum NOx level; a maximum turbine rate; and a minimum oxygen level.

For example the constraint function for turbine speed can be defined as follows:

$$h_{n_{tur}} = n_{tur} - \delta_{n_{tur}}$$

Where $n_{tur}$ is the measured turbine speed and $\delta_{ntur}$ is upper limit of turbine speed.

These gradients provide the change in actual scavenging losses, providing sensitivity 405 to desired scavenging losses $g_{dp}(t)$; sensitivity 406 to the change in actual NOx control error $g_{NOx}(t)$; sensitivity 407 to the change in actual turbo speed $g_{n_{tur}}(t)$; and sensitivity 408 to the change in actual O2% level $g_{O_{2\%}}(t)$. At least some of these gradient values (405-408) are passed to selector mechanism 402 wherein a gradient/sensitivity is selected as being the highest gradient i.e. most sensitive to the perturbation; the switched control variable is then perturbed in an extremum seeking operation on the cost function. To handle multiple objectives with a single performance scheduling variable $u_{perf}$ selector mechanism 402 selects the most relevant sensitivity direction, which may be a weighted average of the sensitivity direction. Such selections may performed by several ways known to the skilled person. One way is as follows and is applicable for multiple constraints.

$$f_{con} := g = \begin{bmatrix} g_{dp} \\ g_{NOx} \\ g_{O_{2\%}} \\ g_{n_{tur}} \end{bmatrix}^{\tau} \begin{bmatrix} (1-\alpha_{NOx})(1-\alpha_{O_{2\%}})(1-\alpha_{n_{tur}}) \\ \gamma_{NOx}\alpha_{NOx}(1-\alpha_{O_{2\%}})(1-\alpha_{n_{tur}}) \\ \gamma_{O_{2\%}}\alpha_{O_{2\%}}(1-\alpha_{n_{tur}}) \\ \gamma_{n_{tur}}\alpha_{n_{tur}} \end{bmatrix}$$

here the switching functions a are defined as 'smooth' switching functions. where the scaling factors, $\gamma_{NOx}$, $\gamma_{O_{2\%}}$, $\gamma_{n_{tur}}$ are tuned such that $\gamma_{NOx}g_{NOx}$, $\gamma_{O_2\%}$, $g_{O_{2\%}}$, and $\gamma_{n_{tur}}g_{n_{tur}}$ are of similar magnitude as $g_{dp}$. For example the switch function for turbine speed could read:

$$\alpha_{ntur} = \frac{1}{1+\exp\left(\frac{-h_{ntur}}{k_{ntur}}\right)}$$

Figure 4:
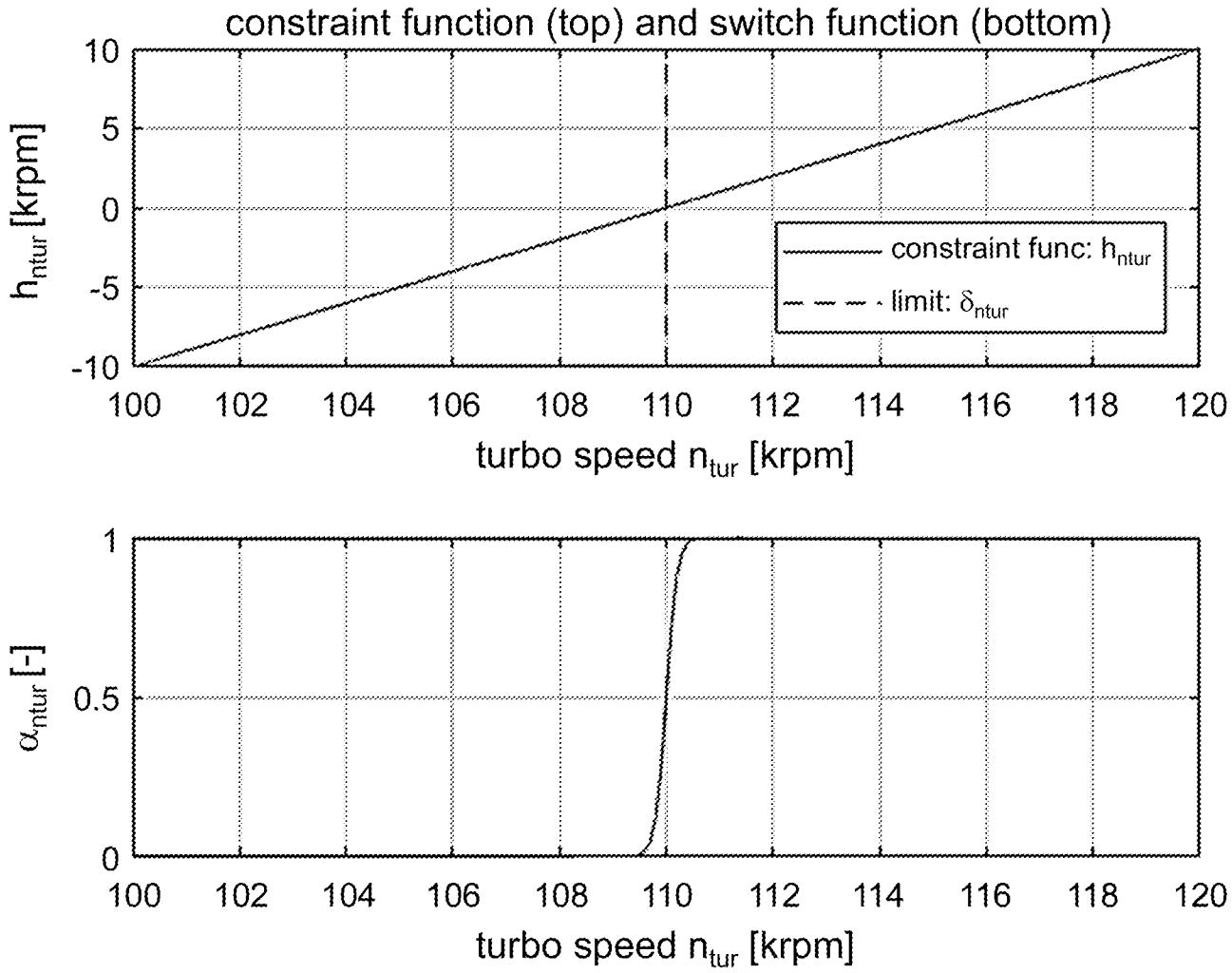
FIG. 4 shows an example graph of the constraint function for h-ntur and the corresponding α-ntur.

In which $h_{ntur}$ is the constraint function earlier described and $\kappa_{ntur}$ is a constant that determines the smoothness of the switch. An example of the constraint function for h-ntur and the corresponding α-ntur are given in FIG. 4.

Note that this selection mechanism provides a priority structure in which exceeding of the NOx constraint has priority over scavenging loss reduction, O2% constraint exceeding has priority over the NOx constraint, and turbine speed has priority over O2%. The selected switched control variable g 404 is inputted to optimizer 403 that is based on integration of the selected gradient $$\dot{u}_{perf}(t) = -k \cdot g(t)$$

By applying this simple feedback rule the system is directed towards the optimum. Note that, in practice the lowering of the scavenging losses will always lead to a limit being reached, albeit the NOx constraint, the O2% constraint or a hardware limitation.

So, the optimum is always a constrained optimum which underlines that the unified approach with the different building blocks; low level NOx control, real-time estimation operation cost through scavenging losses or injector opening time, and constraint handling are an essential part of the engine optimization.

Figure 5:
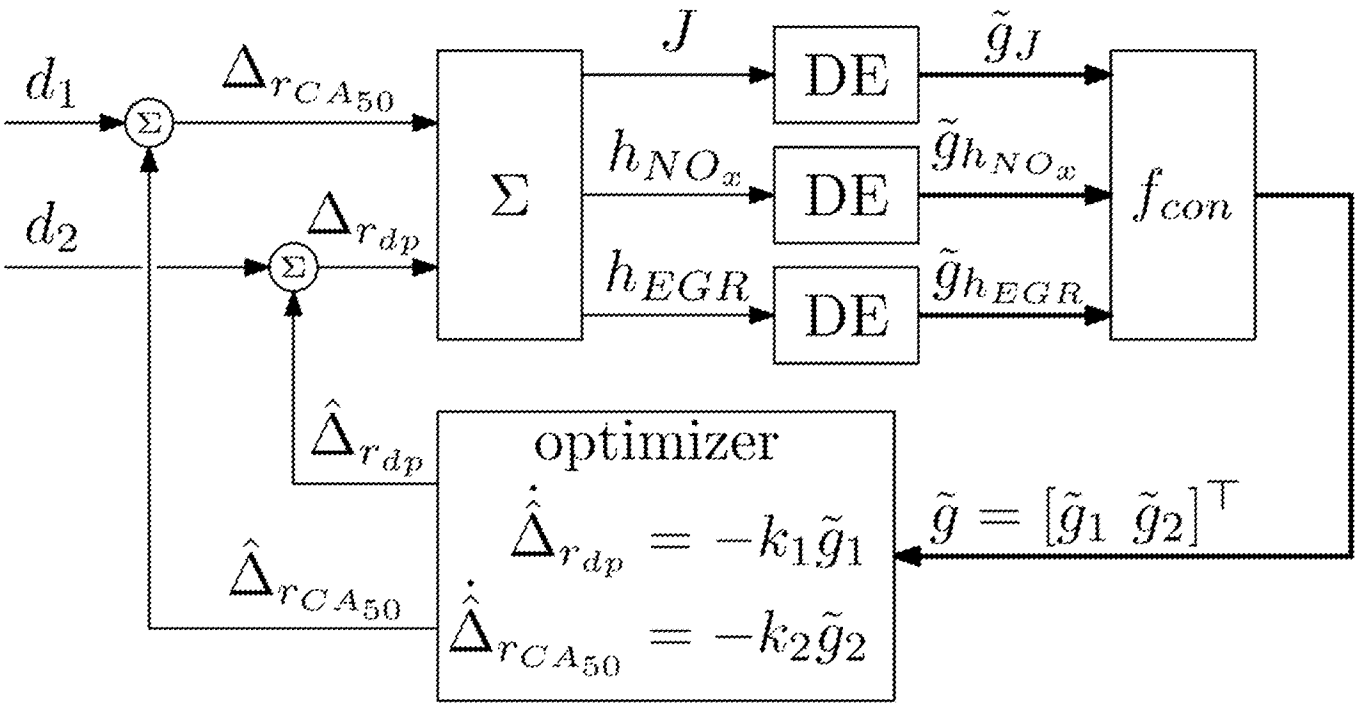
FIG. 5 shows a generalized control scheme for optimizing the fuel path based on a CA50 setting.

FIG. 5 shows a method for air path control of a combustion engine, comprising an EGR valve and a VGT turbine. The method comprises providing a cost function of a measured delta pressure between engine intake and engine exhaust manifold; estimating an NOx emission level in the engine outlet; estimating an oxygen level in the engine outlet; determining constraint functions of a distance between estimated NOx emission level (hNOx), estimated oxygen level and turbine rate and, a maximum turbine rate, a maximum NOx emission level and a minimum oxygen level respectively; determining a gradient (gJ) of the cost function as a function of a delta pressure set point, determining a gradient of the constraint functions (ghNOx) for NOx emission level, turbine speed; and oxygen level and exhaust gas temperature as a function of delta pressure setpoint; real time controlling the NOx emission level and delta pressure to respective desired NOx and delta pressure set points by adjusting the EGR valve and/or the VGT turbine, wherein the delta pressure set point is adjusted in the optimizer according to an integration of a selected gradient direction (−k1g1; −k2g2) of the cost function selected (fcon) from the determined one or more of the gradients [g1,g2], wherein the determined gradients are prioritized in the order of turbine rate, oxygen level and NOx emission level; and wherein NOx emission level and or a turbine rate and or oxygen levels are constrained; and wherein the adjusted delta pressure set point is perturbed (d1, d2) in an extremum seeking operation on the cost function.

A further cost function (J) is provided of a fuel efficiency parameter derived from injector opening times; a combustion phasing parameter (CA50) and IMEP are estimated from in cylinder pressure and encoder measurements real time controlling the NOx emission level and delta pressure to respective desired NOx and delta pressure set points by adjusting the EGR valve and/or the VGT turbine; combustion phasing and indicated mean effective pressure (IMEP) are real time adjusted to respective combustion phasing and IMEP set points; and the delta pressure and fuel efficiency set points are adjusted according to a selected gradient direction of the cost function selected from the determined one or more of the gradients. A selected one gradient is prioritized in the order of turbine rate, oxygen level and NOx emission level; NOx emission level and or a turbine rate and or oxygen level and or exhaust gas temperature are constrained and the adjusted delta pressure and combustion phasing set points are perturbed in an extremum seeking operation on the cost function. The fuel efficiency parameter may be a CA50 measurement variable. The method may further comprise estimating an exhaust gas temperature; determining a maximum or minimum gas temperature; wherein the delta pressure set point is adjusted according to an integration of a gradient direction of the cost function as a function of outlet temperature; wherein the outlet temperature is constrained between a maximum and minimum temperature.

It is thus believed that the operation and construction of the present invention will be apparent from the foregoing description and drawings appended thereto. For the purpose of clarity and a concise description, features are described herein as part of the same or separate embodiments, however, it will be appreciated that the scope of the invention may include embodiments having combinations of all or some of the features described. It will be clear to the skilled person that the invention is not limited to any embodiment herein described and that modifications are possible which may be considered within the scope of the appended claims. Also kinematic inversions are considered inherently disclosed and can be within the scope of the invention. In the claims, any reference signs shall not be construed as limiting the claim. The terms 'comprising' and 'including' when used in this description or the appended claims should not be construed in an exclusive or exhaustive sense but rather in an inclusive sense. Thus expression as 'including' or 'comprising' as used herein does not exclude the presence of other elements, additional structure or additional acts or steps in addition to those listed. Furthermore, the words 'a' and 'an' shall not be construed as limited to 'only one', but instead are used to mean 'at least one', and do not exclude a plurality. Features that are not specifically or explicitly described or claimed may additionally be included in the structure of the invention without departing from its scope. Expressions such as: "means for . . . " should be read as: "component configured for . . . " or "member constructed to . . . " and should be construed to include equivalents for the structures disclosed. The use of expressions like: "critical", "preferred", "especially preferred" etc. is not intended to limit the invention. To the extend that structure, material, or acts are considered to be essential they are inexpressively indicated as such. Additions, deletions, and modifications within the purview of the skilled person may generally be made without departing from the scope of the invention, as determined by the claims.

The invention claimed is:

1. A method for air path control of a combustion engine, comprising an EGR valve and a VGT turbine, the method comprising:

providing a cost function of a measured delta pressure between engine intake and engine exhaust manifold;

estimating an NOx emission level in an engine outlet;

estimating an oxygen level in the engine outlet;

determining constraint functions of a difference between an estimated NOx emission level and a maximum NOx emission level, a difference between an estimated oxygen level and a minimum oxygen level, and a difference between a turbine speed and a maximum turbine speed, respectively;

determining a gradient of the cost function as a function of a delta pressure set point, determining a gradient of the constraint functions as a function of estimated NOx emission level, turbine speed; and oxygen level;

real time controlling the NOx emission level and delta pressure to respective desired NOx and delta pressure set points by adjusting the EGR valve and/or the VGT turbine;

wherein the delta pressure set point is adjusted according to an integration of a gradient direction of the cost function selected from the determined one or more of the gradients, wherein the determined gradients are prioritized in the order of turbine speed, oxygen level and NOx emission level; and wherein NOx emission level and/or a turbine speed and/or oxygen levels are constrained; and wherein the adjusted delta pressure set point is perturbed in an extremum seeking operation on the cost function.

2. The method according to claim 1, further comprising:

estimating an exhaust gas temperature; determining a maximum or minimum gas temperature; wherein the delta pressure set point is adjusted according to an integration of the selected gradient direction of the cost function as a function of engine outlet temperature;

wherein the engine outlet temperature is constrained between a maximum and minimum temperature.

3. The method according to claim 1, wherein the method further comprises providing a further cost function of a fuel efficiency parameter derived from injector opening times;

estimating a combustion phasing parameter and IMEP from in cylinder pressure and encoder measurements real time controlling the NOx emission level and delta pressure to respective desired NOx and delta pressure set points by adjusting the EGR valve and/or the VGT turbine;

real time adjusting combustion phasing and indicated mean effective pressure (IMEP) to respective combustion phasing and IMEP set points;

wherein the delta pressure and fuel efficiency set points are adjusted according to a selected gradient direction of the cost function and further cost function selected from the determined one or more of the gradients, wherein a selected one gradient is prioritized in the order of turbine speed, oxygen level and NOx emission level; and wherein NOx emission level and/or a turbine speed and/or oxygen level and/or exhaust gas temperature are constrained; and wherein the adjusted delta pressure and combustion phasing set points are perturbed in an extremum seeking operation on the cost function.

4. The method according to claim 1 wherein the fuel efficiency parameter is a CA50 measurement variable.

5. A method for air and fuel path control of a combustion engine, comprising an EGR valve, a VGT turbine, and electronically controlled fuel injection settings, the method comprising:

providing a cost function of a fuel economy parameter derived from injector opening time;

estimating a NOx emission level in an engine outlet;

estimating a delta pressure between an intake and exhaust manifold;

estimating a combustion phasing parameter and IMEP from in cylinder pressure and encoder measurements;

estimating an oxygen level in the engine outlet;

determining a maximum turbine speed; a maximum NOx emission level and a minimum or maximum exhaust gas temperature;

determining constraint functions providing a difference between an actual turbine speed and the maximum turbine speed, a difference between an actual NOx emission level and the maximum NOx emission level, and a difference between an actual exhaust gas temperature and the minimum or maximum exhaust gas temperature;

determining a gradient of the cost function as a function of a set point for delta pressure between engine intake and exhaust manifold; and combustion phasing;

determining a gradient of the constraint functions as a function of a setpoint for delta pressure between engine intake and exhaust manifold; and combustion phasing;

real time adjusting the EGR valve and/or VGT position, injection timing and quantity by static decoupling and controlling the NOx emission level and delta pressure, combustion phasing and IMEP to respective desired set NOx, delta pressure, combustion phasing and IMEP set points;

wherein the delta pressure and combustion phasing set points are adjusted according to a selected gradient direction of the cost function selected from the determined one or more of the gradients;

wherein a selected one gradient is prioritized in the order of turbine speed, oxygen level, NOx emission level and exhaust gas temperature;

wherein NOx emission and/or a turbine speed are constrained to a set variables of a maximum NOx level; a maximum turbine speed; and a minimum oxygen level and a minimum or maximum exhaust gas temperature;

wherein the adjusted delta pressure and combustion phasing setpoints are perturbed in an extremum seeking operation on the cost function.

* * * * *